US005564942A

United States Patent [19]

Lee

[11] Patent Number: 5,564,942

[45] Date of Patent: Oct. 15, 1996

[54] CONNECTOR FOR AN ELECTRICAL SIGNAL TRANSMITTING CABLE

[75] Inventor: Noel Lee, Daly City, Calif.

[73] Assignee: Monster Cable International, Ltd., Bermuda

[21] Appl. No.: 391,964

[22] Filed: Feb. 21, 1995

[51] Int. Cl.[6] ..... H01R 13/58

[52] U.S. Cl. ..... 439/462; 439/584

[58] Field of Search ..... 439/461, 462, 439/589, 578

[56] References Cited

U.S. PATENT DOCUMENTS

D. 323,643 2/1992 Lee .
D. 325,023 3/1992 Lee et al. .
D. 328,280 7/1992 Lee .
D. 329,223 9/1992 Lee .
3,581,269 5/1971 Frey ..... 439/584 OR
4,932,897 6/1990 Lee et al. .
5,352,134 10/1994 Jacobsen et al. ..... 439/584 OR
5,362,251 11/1994 Bielak ..... 439/584 X
5,474,478 12/1995 Ballog ..... 439/578 X

*Primary Examiner*—Khiem Nguyen
*Assistant Examiner*—Daniel Wittels
*Attorney, Agent, or Firm*—Haynes and Boone, L.L.P.; Warren B. Kice

[57] ABSTRACT

A connector for connection to an electrical cable and including an inner sleeve for receiving the electrical cable and being formed, at least in part, by a plurality of angularly-spaced segments. An outer barrel is also provided which extends over the inner sleeve and which includes a camming surface for engaging the segments of the inner sleeve and camming the segments radially inwardly into engagement with the cable to secure the cable to the connector.

7 Claims, 1 Drawing Sheet

CONNECTOR FOR AN ELECTRICAL SIGNAL TRANSMITTING CABLE

BACKGROUND OF THE INVENTION

This invention relates to a connector for an electrical transmitting cable and, more particularly, to such a cable for providing a connection from the cable to a jack on an electronic component.

The most common connector utilized for connecting electronic components, such as those used in home audio and video systems, utilize what is commonly referred to as a "RCA" connector which consists of a cylindrical member adapted for connection at one end to a cable and having a pin and a contact, or ground, sleeve projecting from the other end. The pin engages in a corresponding socket in a terminal, or jack, to form the "positive" connection, and the contact sleeve extends over a cylindrical flange of the jack in an interference fit to form the "negative", or ground, connection. As a result, current can flow to the component from a component connected to the other end of the cable.

However, it is extremely difficult to secure the cable to the connector in a manner to withstand the significant tensile stresses on the connection that are created when the connector is removed from the jack. Although various crimping techniques have been tried to secure the connection, they have been less than completely successful.

SUMMARY OF THE INVENTION

It is therefore an object of the present invention to provide a connector which connects to an electrical transmitting signal cable in a manner to withstand significant tensile stresses on the connection.

It is a further object of the present invention to provide a connector of the above type which provides a relatively high tensile-strength connection between it and the signal cable.

It is a further object of the present invention to provide a connector of the above type which enables a manually-applied camming force to be applied by the connector to the signal cable.

Towards the fulfillment of these and other objects, the connector of the present includes an inner sleeve for receiving an electrical cable and being formed, at least in part, by a plurality of angularly-spaced segments. An outer barrel is also provided which extends over the inner sleeve and which includes a camming surface for engaging the segments of the inner sleeve and camming the segments radially inwardly into engagement with the cable to secure the cable to the connector.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
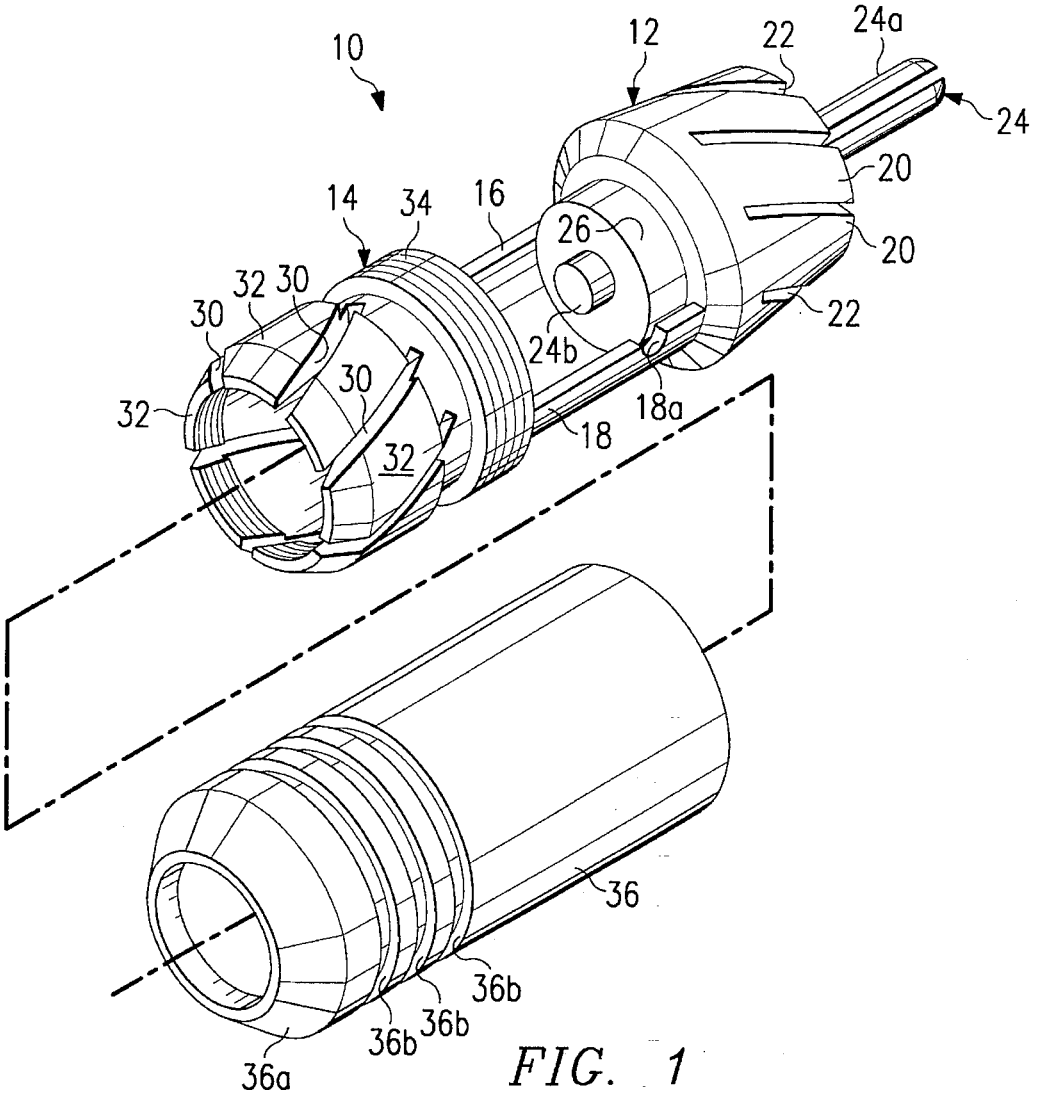
FIG. 1 is an exploded, perspective view of the connector of the present invention.

Referring to the drawings, the reference numeral 10 refers, in general, to the connector of the present invention, which includes a front, or leading, sleeve 12 connected to a rear, or trailing, sleeve 14 by a pair of struts 16 and 18. The front sleeve 12 is formed by six individual segments 20 formed by cutting six equiangularly-spaced slots 22 in the sleeve. After the slots are cut, the distal end portions of the segments 20 are bent slightly radially inwardly so that the sleeve is tapered slightly towards its end. A pin 24 extends coaxially within the sleeve 12 and through a transversely-extending plate 26 disposed within the sleeve. The leading end portion **24*a* of the pin is split and projects outwardly from the sleeve while the other end portion 24*b* of the pin projects outwardly from the plate 26. The plate 26 is stepped and receives a seal ring 28 which engages the outer surface of the pin 24** to support the pin and provide a seal.

Six equiangularly-spaced slots 30 are also cut in the rear end portion of the sleeve 14 to form six spaced segments 32. After the 30 slots are cut, the distal end portions of the segments 32 are bent slightly radially inwardly so that the sleeve is tapered slightly towards its end. The other end portion of the sleeve 14 has threads 34 formed on its outer surface for reasons to be described.

An outer barrel, or sleeve, 36 is provided which extends over the assembly formed by the sleeves 12 and 14 and the struts 16 and 18. A portion of the internal surface of the barrel 36 is provided with threads 38 which engage the threads 34 on the sleeve 14 to secure the barrel in the assembled position shown in FIG. 2. The rear, or trailing, end portion **36*a* of the barrel 36 is tapered inwardly so that, when the barrel is advanced over the latter assembly, the tapered end portion engages the segments 32 of the sleeve 14 and forces them inwardly, as will be described. The outer surface of the barrel 36 is provided with a plurality of grooves 36*b*** for receiving rings (not shown) for identification purposes.

Figure 2:
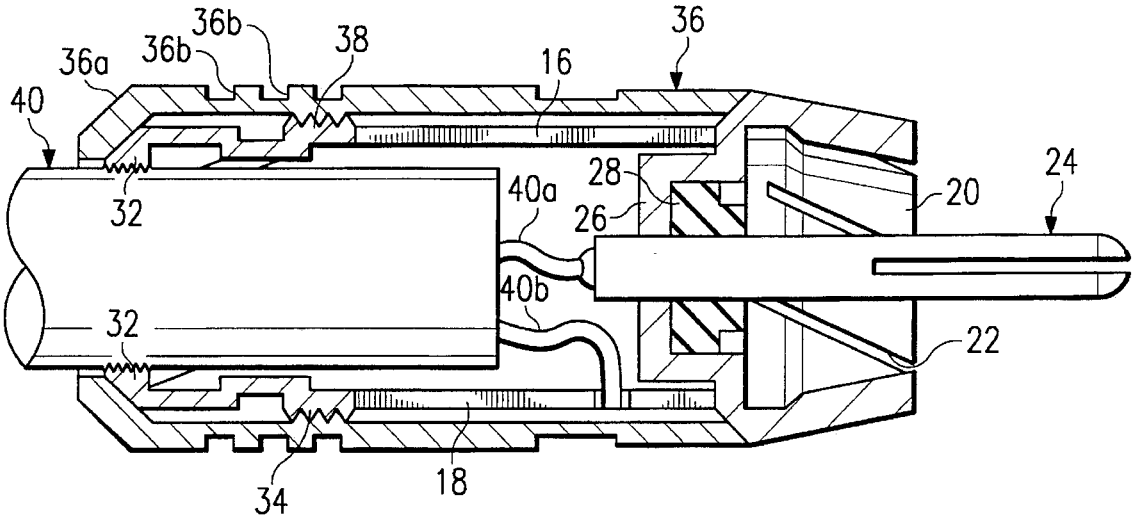
FIG. 2 is a cross-sectional view of the connector of FIG. 1.

In use, the barrel 36 is removed from the assembly formed by the sleeves 12 and 14 and the struts 16 and 18 and is placed over one end portion of a cable assembly 40 (FIG. 2). The cable assembly 40 is of a conventional design and includes two conductors **40*a* and 40*b* surrounded by an outer insulative sleeve and adapted to transmit the positive and negative portions, respectively, of an electric signal from a component, or the like, connected to the other end portion of the cable assembly. The end portion of the outer insulative sleeve of the cable assembly 40 is stripped away and is the latter is inserted into the assembly formed by the sleeves 12 and 14 and the struts 16 and 18 until the exposed portions of the conductors 40*a* and 40*b* extend in the space between the sleeves 12 and 14. The conductor 40*a* is soldered, or otherwise connected, to the end portion 24*b* of the pin 24. The conductor 40*b* is placed in a notch 18*a* formed in the strut 18 and is soldered., or otherwise connected, to the latter strut 18*a***.

The barrel 36 is then advanced over the sleeve 14 until the threads 38 of the barrel engage the threads 34 of the sleeve 14. The barrel is then rotated to further advance the barrel over the struts 16 and 18 and the sleeve 12 until it extends in the assembled condition of FIG. 2. During this advancement of the barrel 36, the tapered end portion 36*a* of the barrel engages the segments 32 of the rear sleeve 14 and forces, or cams, the latter segments inwardly into engagement with the outer insulative sleeve of the cable assembly 40. It is understood that the barrel portion 36*a* and the segments 32 are sized so that the above camming action is sufficient to securely fasten the cable assembly in the position shown in FIG. 2 while not damaging the outer insulative sleeve of the latter assembly.

The connector 10 is then advanced towards a conventional jack, or terminal, (not shown) of an electrical component, or the like, to which the cable assembly 40 is to be connected. The pin 24 enters a socket formed by the jack and, upon further advancement, the sleeve 12 extends over, and engages a circular flange of the jack, with the segments 20 providing spring tension against the outer surface of the flange. This advancement continues until the pin 24 "bottoms out" in the socket of the jack and the flange of the jack extends completely within the sleeve 12. Electrical current can then flow from the conductor 40*a* of the cable assembly 40, through the pin 24, the socket of the jack and to the component associated with the jack; and back through the flange of the jack, the sleeve 12 and the conductor 40*b*.

The connector 10 thus provides several advantages. For example, it enables a manually-applied camming force to be applied by the connector to the signal cable to provide a relatively strong connection that can withstand significant tensile stresses. Also, an adequate area is provided between the spaced sleeves 12 and 14 to enable the ends of the conductors 40*a* and 40*b* to be soldered to the appropriate portions of the connector, as described above.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A connector for connection to a cable assembly, said connector comprising an inner sleeve for receiving the cable and comprising a first sleeve portion, a second sleeve portion spaced from said first sleeve portion, and at least one strut connecting said sleeve portions in a spaced relation, one of said sleeve portions being formed, at least in part, by a plurality of angularly-spaced segments; and an outer barrel extending over said one sleeve portion, said outer barrel including a camming surface for engaging said segments and camming said segments radially inwardly into engagement with said cable to secure said cable assembly to said connector.

2. The connector of claim 1 wherein said outer slêeve is advanced over said inner barrel in a manner to cause said camming.

3. The connector of claim 2 further comprising a first set of threads formed on the outer surface one of said sleeve portions and a second set of threads formed on the inner surface of said barrel and adapted to engage set first said of threads upon said advancement.

4. The connector of claim 1 further comprising a pin supported by said sleeve and having a first end portion projecting outwardly from one of said sleeve portions for engaging a jack of an electrical component.

5. The connector of claim 4 wherein said cable assembly has two conductors and said pin has a second end portion located in said space between said sleeve portions and connected to one of said conductors.

6. The connector of claim 5 wherein the other conductor of said cable assembly is connected to said at least one strut.

7. The connector of claim 6 wherein the space between said sleeve portion is sufficient to enable said conductors to be soldered to said pin portion and to said strut, respectively, to form said connections.

* * * * *

UNITED STATES PATENT AND TRADEMARK OFFICE

CERTIFICATE OF CORRECTION

PATENT NO. : 5, 564,942

DATED : October 15, 1996

INVENTOR(S) : Noel Lee

It is certified that error appears in the above-indentified patent and that said Letters Patent is hereby corrected as shown below:

Col. 1, line 45, after "present" insert --invention--.

Col. 2, line 53 which begins with "sleeve of the cable", delete the second occurrence of the word "is".

Col. 2, line 61, after "soldered", delete the period before the comma.

Col. 4, line 19, after "surface", insert --of--.

Col. 4, line 21, after engage, delete "set" and insert --said--.

Col. 4, line 21, after first, delete "said" and insert --set--.

Signed and Sealed this

Sixth Day of May, 1997

*Attest:*

*Attesting Officer*

Bruce Lehman

BRUCE LEHMAN

*Commissioner of Patents and Trademarks*